252-99 AU 165 EX
1/4/77 OR 4,001,131

United States Patent [19]
Montgomery

[11] 4,001,131
[45] Jan. 4, 1977

[54] ACTIVATION OF ORGANIC PERACIDS BY DI-KETONES

[75] Inventor: Ronald Earl Montgomery, Cincinnati, Ohio

[73] Assignee: The Procter & Gamble Company, Cincinnati, Ohio

[22] Filed: June 3, 1975

[21] Appl. No.: 583,383

[52] U.S. Cl. ..... 252/99; 8/111; 252/95

[51] Int. Cl.[2] ..... C11D 7/56

[58] Field of Search ..... 252/99, 95; 8/111

[56] References Cited

UNITED STATES PATENTS

| | | | |
|---|---|---|---|
| 3,822,114 | 7/1974 | Montgomery | 252/95 |
| 3,919,102 | 1/1975 | Kuhling et al. | 252/95 X |

*Primary Examiner*—Mayer Weinblatt
*Attorney, Agent, or Firm*—Charles R. Wilson; Jerry J. Yetter; Richard C. Witte

[57] ABSTRACT

Bleaching compositions and processes for activating peroxygen bleaching agents using di-ketones.

14 Claims, No Drawings

ACTIVATION OF ORGANIC PERACIDS BY DI-KETONES

BACKGROUND OF THE INVENTION

1. Field of the Invention

This invention relates to bleaching compositions. More particularly, the invention encompasses improved bleaching compositions and a process for activating peroxygen bleaching agents not only to bleach fabrics, but also to inhibit dye transfer during the wash cycle of a laundering procedure.

It is known that peroxygen bleaches such as diperoxyisophthalic acid, m-chloroperbenzoic acid, sodium perborate and the like, can be used in washing and beaching baths to aid in the cleansing and bleaching of fabrics. In general, however, optimum cleaning and bleaching with peroxygen bleaches occurs at temperatures near or above the boiling point of water, especially when sodium perborate type bleaches are used. When such peroxygen bleaches are employed in the wash bath at temperatures below about 90° C, sub-optimal cleansing and bleaching occurs because the release of active oxygen does not proceed with sufficient rapidity. Thus, there is a continuing search for compositions and methods to bleach and inhibit dye transfer of textiles and fabrics effectively at temperatures below 90° C, e.g., in the 30° C to 80° C temperature range typical of modern washing machines used in the United States.

Peroxygen bleaches are especially desirable for use on fabrics due to their marked superiority in providing improved hand feel, improved absorbency, permanency of whiteness, color safety, and low rate of dye transfer in colored fabrics, in comparison with the harsh hypochlorite bleaches. Despite their many potential advantages, sodium perborate type peroxygen bleaches suffer from the disadvantage that optimum realization of their beneficial properties can only be achieved at unusually high laundry bath temperatures. Thus, it is essential to incorporate an activator in compositions containing the peroxygen bleaches to catalyze their bleaching and dye transfer inhibition action, thereby providing effective bleaching at somewhat lower temperatures.

It has now surprisingly been found that the use of certain di-ketones in combination with certain organic peroxygen bleaching agents provides a significant improvement in the cleansing and bleaching of fabrics. Moreover, the di-ketone/peroxygen bleaches herein serve to inhibit dye transfer between colored fabrics during a laundering process at normal wash temperatures.

2. The Prior Art

The use of chlorine and active oxygen bleaches to enhance cleansing and to remove stains from fabrics during a laundering operation is well-known.

U.S. Pat. No. 3,882,114, Montgomery, Bleaching Process and Compositions Therefor, July 4, 1974, describes a dry bleach composition containing a peroxyacid bleaching agent, an aldehyde- or ketone-producing activator, and a buffering agent. Aliphatic, aromatic, or cyclic ketones which can be either saturated, unsaturated, substituted or unsubstituted are disclosed. The di-ketones used herein are superior to those activators and dye transfer inhibitors disclosed in the '114 patent.

U.S. Pat. No. 3,775,322, Heins, et al., Method of Activating Per-Compounds and Solid Activated Per-Compound Compositions, Nov. 27, 1973, relates to the activation of solid inorganic per-compounds such as the perborates utilizing acetylated glycolurils and diacylated 2,5-diketopiperazines.

U.S. Pat. No. 3,775,333, Loffelman, et al., N-acyl Azolinones as Peroxygen Bleach Activators, November 27, 1973, teaches the activation of peroxygen bleaches using N-acyl azolinone type compounds. The activated bleach compositions are described as effective at low temperatures (e.g. 50°–° C).

Other prior art bleaching compositions have employed various types of such activator compounds including esters, carboxylic acid anhydrides, quaternary ammonium salts and carboxylic acid salts, among others. (See; Popkin, U.S. Pat. No. 1,940,768, Dec. 26, 1973; Baevsky, U.S. Pat. No. 3,061,550, Oct. 30, 1962; MacKellar, et al., U.S. Pat. No. 3,338,839, Aug. 29, 1967; Woods, U.S. Pat. No. 3,532,634, Oct. 6, 1970; and Staher, U.S. Pat. No. 3,556,711, Jan. 19, 1971. U.S. Pat. Nos. 3,739,673 and 3,749,674, Jones and Nicol, each relate to activated bleaches and their use to combat dye transfer.) While certain of these activators are presumably effective, there is a continuing need for activators other than those presently employed in the art so that better bleaching performance and dye transfer inhibition can be obtained with peroxygen bleaches.

The bleaching compositions and processes herein can be used in several ways to solve cleaning and laundering problems encountered in the home. The bleaches can be used to remove stains from fabrics and hard surfaces. The bleaches can also be formulated in combination with detersive surfactants, builders, and the like, to provide fully-formulated bleaching cleansers and laundry detergents. Moreover, the compositions herein help combat one of the most persistent and troublesome problems arising during a fabric laundering operation, i.e., the release of dyes into laundering solutions and transfer of the dyes to other fabrics being washed. Heretofore, there has been no reliable way to combat the problem of dye transfer, other than by mechanically sorting the fabrics to partition them into dark and light shades for separate laundering.

In light of the foregoing considerations concerning direct bleaching and dye transfer in laundering, it is an object of the instant invention to provide improved methods for enhancing the activity of peroxygen bleaches.

It is a further object of this invention to provide improved concentrated bleaching compositions for use alone, or in conjunction with other conventional laundering agents.

It is yet another object herein to provide compositions which prevent visible dye transfer onto fabrics.

These and other objects are obtained herein as will be seen from the following disclosure.

SUMMARY OF THE INVENTION

In its broadest aspect, the composition of this invention comprises:

a. from 1 to 75% (wt.) of a water-soluble organic peroxyacid bleaching agent;

b. from 0.1% to 50% (wt.) of a water-soluble diketone activator of the formula $$R-\overset{O}{\overset{\|}{C}}-(CH_2)_n-\overset{O}{\overset{\|}{C}}-R'$$

wherein n is 0 or 1 and R and R′ are members selected from the group consisting of alkyl and substituted alkyl moieties having from 1 to 20 carbon atoms; aryl and substituted aryl moieties; or heterocyclic moieties; and moieties wherein R and R′ are joined in a ring structure having 5 to 12 carbon atoms;

c. a buffering agent sufficient to maintain the in-use pH of the composition within the range of from 6 to 10; and d. optionally a detergent composition.

This invention additionally provides an improved activated peroxygen bleaching and dye transfer inhibiting process comprising contacting soiled fabrics with an aqueous solution containing an effective amount of a composition of the above type.

DETAILED DESCRIPTION OF THE INVENTION

The present invention is based on a means for activating peroxygen bleaches and encompasses compositions utilizing the resulting activated bleaches as practical stain removers. The activated bleaching process is carried out by conjointly dissolving a peroxygen bleaching compound, an activator compound and a buffer in water to provide an activated bleach bath. Stains (or dyes) contacted by an effective amount of the bath are bleached and/or removed.

The combination of peroxygen bleach/activator/-buffer herein is useful in at least three major areas: (1) direct bleaching of stains on fabrics or hard surfaces; (2) inhibition of the transfer of solubilized or suspended dyes found in fabric laundering solutions onto fabrics; and (3) in combination with detersive surfactants as fully-formulated bleaching cleansers for use on fabrics or hard surfaces.

The essential peroxygen bleach, activator, and buffer components of the instant invention are described in detail, below.

Peroxygen Compound

The active bleaches used in the present invention are the water-soluble peroxyacids, and the water-soluble salts thereof. The alkali and ammonium salts are highly preferred herein, as are the water-soluble free acid forms of the peroxyacids.

Operable peroxyacids of the present invention are of the general formula

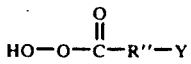

wherein R″ is an alkylene group containing from 1 to about 16 carbon atoms or an arylene group containing from 6 to about 8 carbon atoms and Y is hydrogen, halogen, alkyl, aryl or any group which provides an anionic moiety in aqueous solution. Such Y groups can include, for example,

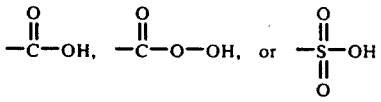

The water-soluble organic peroxyacids or salts thereof of the invention can contain either one or two peroxy groups and can be either aliphatic or aromatic.

Preferred aliphatic, peroxyacids used herein are of the general formula

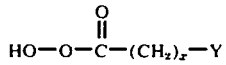

where Y, for example, can be $CH_3$, $CH_2Cl$, or the groups set forth hereinabove. In the formula $x$ is an integer from 1 to 12 (with $x = 7$ being the preferred compound). The aklylene linkage and/or Y group (if alkyl) can contain halogen or other non-interfering substituents. Examples of highly preferred aliphatic peroxyacids include diperoxyazelaic acid and diperoxyadipic acid and water-soluble salts thereof.

When the organic peroxyacid is aromatic, the unsubstituted acid has the general formula

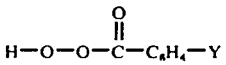

where Y is, for example, hydrogen, halogen, alkyl, or the groups set forth above. Such Y groupings can be in any relative position around the aromatic ring. The ring and/or Y group (if alkyl) can contain any non-interfering substituent such as halogen, etc.

Examples of suitable aromatic peroxy acids and salts thereof include monoperoxyphthalic acid, diperoxyterephthalic acid, 4-chlorodiperoxyphthalic acid and the monosodium salt of diperoxyterephthalic acid. Preferred aromatic peroxyacids include m-chloroperoxybenzoic acid and p-nitroperoxybenzoic acid. A highly preferred aromatic peroxyacid is diperoxyisophthalic acid.

It is to be understood that higher molecular weight peroxyacids, (generally $C_6$, and above) are used in their salt form, which renders them water-soluble. Mixtures of the peroxygen salt compounds and the peroxyacids can be employed in the instant process.

The foregoing peroxyacid bleaching agents are dissolved conjointly with a bleach activator and a buffer in aqueous solutions to carry out the activated bleaching and/or dye transfer inhibition processes provided by the instant invention. Sufficient peroxyacid to provide from about 2 ppm to 2,000 ppm available oxygen in solution is used; the peroxyacid is generally in solution at a concentration of from about 10 ppm to 20,000 ppm, preferably 25 ppm to 1000 ppm, which is sufficient to provide the desirable level of available oxygen. The actual concentration employed in a given bleaching solution can be varied widely, depending on the intended use of the solution.

In general, the peroxyacid bleaching agent is present in the bleaching compositions of the instant invention to the extent of from about 1 to 75% by weight. Again, preferred concentration ranges for the peroxygen bleaching agent in concentrated compositions depends upon the particular utility for which a given composition is prepared. Such preferred embodiments are discussed more fully hereinafter.

The Organic Peroxyacid Activator

The peroxygen bleaches of the instant invention are activated by certain di-ketones of the formula set forth hereinabove and are characterized by two ketonic carbonyl groups which are adjacent or "next-adjacent", i.e., separated by not more than one carbon atom. If the two ketonic carbonyl groups are separated by more than one carbon atom, performance of the dye transfer inhibiting compositions herein is markedly reduced. Accordingly, for superior dye transfer inhibition, either adjacent or next adjacent, di-ketonic groups are critical.

Examples of aliphatic di-ketones which are suitable for use herein include 2,3-butanedione; 2,3-pentanedione; 1,2-cyclohexanedione; 1-phenylpropane-1,2-dione; 2,4-pentanedione, di-2-pyridyl glyoxal, or 2,4-hexanedione.

The compositions of the instant invention can be either liquid or solid. The liquid compositions are, however, less storage stable than the dry compositions.

Aromatic $\alpha$-diketones such as benzil(diphenyl diketone) or nitro, bromo, or chloro-substituted benzils are solid di-ketones, but in general have low water solubility. This fact somewhat limits the use of these materials as bleach activators in aqueous solution; however, substitution with groups such as,

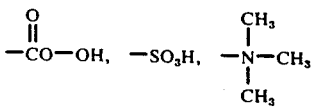

which can render aromatic di-ketones water-soluble under the pH conditions of interest, produces operable water-soluble, solid $\alpha$-diketones. Substitution of the above disclosed groups can provide water-solubility to other di-ketones or heterocyclic di-ketones which have limited water-solubility. It should be understood that these substitutions are desirable only so far as they do not separate the di-ketone groups or otherwise interfere with the functional operability of the di-ketones as activators.

The most preferred activators are 2,3-butanedione, 2,3-pentanedione, and di-2-pyridyl gloxal.

The di-ketones are used in the instant compositions at levels of from about 0.1 to 50% (wt.); concentrations of 0.5 to 10% (wt.) are especially preferred for most purposes. It should be understood that the concentration range for the di-ketones of the bleaching and dye transfer inhibition compositions depend to a large extent on the concentration of the peroxyacid in the composition which, in turn, depends on the particular use for which a given composition is formulated. Higher or lower levels within the range can be selected according to the desires of the formulator. Overall, the best bleaching and dye inhibition results are obtained when the peroxyacid and di-ketone are used in a mole ratio in the range of from 10:1 to 1:3, preferably 5:1 to 1:1 of acid to di-ketone.

In use, the activator is generally present in aqueous solution to the extent of from about 5.0 ppm to about 5,000 ppm.

The Buffering Agent

Activation of the peroxygen bleaches and the bleaching and dye transfer inhibition is carried out in aqueus solution at a pH of from about 6 to about 10, most preferably 7.0 to 9.0. Outside this pH range bleach activation and performance fall off markedly. Since an aqueous solution of the persalts or peracids of the present invention is generally acidic, it is necessary to maintain the requisite alkaline pH conditions by means of buffering agents. Buffering agents suitable for use herein include any non-interfering compound which can alter and/or maintain the solution pH within the desired range, and the selection of such buffers can be made by referring to a standard text.

For example, phosphates, carbonates, or bicarbonates which buffer within the pH range of 6 to 10 are useful. Examples of suitable buffering agents include sodium bicarbonate, sodium carbonate, disodium hydrogen phosphate and sodium dihydrogen phosphate. Buffering agents generally comprise from about 1 to about 85% by weight of the instant bleaching compositions and are used at 1 ppm to 10,000 ppm in solution.

It is to be appreciated that the activated bleaches of the present invention can be provided for use in combination with a detersive surfactant or fully-formulated built detergent. Such compositions will comprise from about 1 to 50% by weight of the activated bleach composition, from 1 to 50% by weight of the detersive surfactant, and can optionally contain from 1 to 60% by weight of a detergency builder (which can conveniently serve as the buffer). Suitable detersive surfactants in such compositions are as follows.

Surfactant

Water-soluble detersive surfactants optionally used in the present compositions include any of the common nonionic, anionic or cationic detersive surface active agents well known in the detergent arts. Mixtures of such surface active agents can also be employed as the surfactant component of the present compositions. More particularly, the surfactants listed in U.S. Pat. Nos. 3,332,880 and 3,697,364 issued Sept. 26, 1972, to J. B. Edwards, each incorporated herein by reference, can be used herein as will be disclosed more fully hereinafter.

Non-limiting examples of surfactants suitable for use in the instant compositions and processes are as follows.

Highly preferred surfactants herein comprise the typical nonionic surfactants well known in the detergency arts. Such surfactants can be generally described as the condensation products of an alkylene oxide (hydrophilic in nature), especially ethylene oxide (EO), with an organic hydrophobic compound, which is usually aliphatic or alkyl aromatic in nature. The length of the hydrophilic (i.e., polyoxyalkylene) moiety which is condensed with any particular hydrophobic compound can be readily adjusted to yield a water-soluble compound having the desired degree of balance between hydrophophilic and hydrophobic elements. Specific examples of suitable nonionic surfactants include the following.

The polyethylene oxide condensates of alkyl phenols are a well-known type of water-soluble ethoxylated nonionic surfactant. These compounds include the condensation products of alkyl phenols having an alkyl group containing from about 6 to 12 carbon atoms in either a straight chain or branched chain configuration, with ethylene oxide, said ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol; dodecyl phenol condensed with about 12 moles of ethylene oxide per mole of phenol; diononyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by the GAF Corporation, and Triton X-45, X-114, X-100 and X-102, all marketed by the Rohm and Haas Company.

The condensation products of aliphatic alcohols with ethylene oxide are another (and highly preferred) type of nonionic surfactant used herein. The alkyl chain of the aliphatic alcohol can be either straight or branched, and generally contains from about 8 to about 22, preferably 10 to 16, carbon atoms. Examples of such ethoxylated alcohols include the condensation product of about 6 moles of ethylene oxide with 1 mole of tridecanol; myristyl alcohol condensed with about 10 moles of ethylene oxide per mole of myristyl alcohol; the condensation product of ethylene oxide with coconut fatty alcohol wherein the coconut alcohol is a mixture of fatty alcohols with alkyl chains varying from 10 to 14 carbon atoms in length and wherein the condensate contains about 6 moles of ethylene oxide per mole of alcohol; and the condensation product of about 9 moles of ethylene oxide with the above-described coconut alcohol. Tallow alcohol ethoxylates $(EO)_6$ to $(EO)_9$ are similarly useful herein. Examples of commercially available nonionic surfactants of the foregoing type include Tergitol 15-S-9, marketed by the Union Carbide Corporation; Neodol 23-6.5, marketed by the Shell Chemical Company; and Kyro EOB, marketed by The Procter and Gamble Company.

The condensation products of ethylene oxide with a hydrophobic base formed by the condensation of propylene oxide with propylene glycol constitute another type of nonionic surfactant. The hydrophobic portion of these compounds has a molecular weight of from about 1500 to 18000 and, of course, exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluronic surfactants, marketed by BASF Wyandotte.

The condensation products of ethylene oxide with the product resulting from the reaction of propylene oxide and ethylene diamine are another type of nonionic surfactant used herein. The hydrophobic "base" of these condensation products consists of the reaction product of ethylene diamine and excess propylene oxide, said base having a molecular weight of from about 2500 to about 3000. This base compound is thereafter condensed with ethylene oxide to the extent that the condensation product contains from about 40 to about 80% by weight of polyoxyethylene and has a molecular weight of from about 5,000 to about 11,000. Examples of this type of nonionic surfactant include certain of the commercially available Tetronic compounds, marketed by BASF Wyandotte.

Water-soluble salts of the higher fatty acids, i.e., "soaps" are useful anionic surfactants herein. This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present invention are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms, in straight chain or branched chain configuration, e.g., those of the type described in U.S. Pat. Nos. 2,220,099 and 2,477,383. Linear straight chain alkyl benzene sulfonates in which the average of the alkyl groups is about 13 carbon atoms, abbreviated as $C_{13}$LAS, as well as $C_{11.8}$(avg.)LAS are typically used.

Other anionic surfactant compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups containing about 8 to about 12 carbon atoms.

Other useful anionic surfactants herein include the water-soluble salts of esters of $\alpha$-sulfonated fatty acids containing from about 6 to 20 carbon atoms in the ester group; water-soluble salts of 2-acyloxy-alkene-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble anionic organic surfactants herein include linear alkyl benzene sulfonates containing from about 11 to 14 carbon atoms in the alkyl group; the tallow range alkyl sulfates; the coconut range alkyl glyceryl sulfonates; alkyl ether (ethoxylated) sulfates wherein the alkyl moiety contains from about 14 to 18 carbon atoms and wherein the average degree of ethoxylation varies between 1 and 6; the sulfated condensation products of tallow alcohol with from about 3 to 10 moles of ethylene oxide; olefin sulfonates containing from about 14 to 16 carbon atoms; and soaps, as hereinabove defined.

Specific preferred anionic surfactants for use herein include: sodium linear $C_{10}$–$C_{18}$ alkyl benzene sulfonate; triethanolamine $C_{10}$–$C_{18}$ alkyl benzene sulfonate; sodium tallow alkyl sulfate; sodium coconut alkyl glyceryl ether sulfonate; the sodium salt of a sulfated condensation product of a tallow alcohol with from about 3 to about 10 moles of ethylene oxide; and the water-soluble sodium and potassium salts of higher fatty acids containing 10 to 18 carbon atoms.

It is to be recognized that any of the foregoing anionic surfactants can be used separately herein or as mixtures.

Semi-polar surfactants useful herein include water-soluble amine oxides containing one alkyl moiety of from about 10 to 28 carbon atoms and 2 moieties selected from the group consisting of alkyl moieties and hydroxyalkyl moieties containing from 1 to about 3 carbon atoms; water-soluble phosphine oxides containing one alkyl moiety of about 10 to 28 carbon atoms and 2 moieties selected from the group consisting of alkyl moieties and hydroxyalkyl moieties containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water solubilizing group.

Detergency Builder

The instant compositions optionally contain a detergency builder, and all manner of detergency builders commonly taught for use in detergent compositions are useful in combination with the present activated bleaching compositions. More specifically, the detergent/bleaches herein can contain from about 0 to about 95%, most preferably from about 15 to about 65%, by weight of said builders. Useful builders herein include any of the conventional inorganic and organic water-soluble builder salts, as well as various water-soluble and so-called "seeded" builders.

Inorganic detergency builders useful herein include, for example, water-soluble salts of phosphates, pyrophosphates, orthophosphates, polyphosphates, silicates, carbonates, and the like. Organic builders include various water-soluble phosphonates, polyphosphonates, polyhydroxysulfonates, polyacetates, carboxylates, polycarboxylates, succinates, and the like.

Specific examples of inorganic phosphate builders include sodium and potassium tripolyphosphates, phosphates, and hexametaphosphates. The organic polyphosphonates specifically include, for example, the sodium and potassium salts of ethane 1-hydroxy-1,1-diphosphonic acid and the sodium and potassium salts of ethane-1,1,2-triphosphonic acid. Examples of these and other phosphorus builder compounds are disclosed in U.S. Pat. Nos. 3,159,581; 3,213,030; 3,422,021; 3,422,137; 3,400,176 and 3,400,148, incorporated herein by reference. Sodium tripolyphosphate is an especially preferred, water-soluble inorganic builder herein.

Non-phosphorus containing sequestrants can also be selected for use herein as detergency builder.

Specific examples of non-phosphorus, inorganic builder ingredients include water-soluble inorganic carbonate, bicarbonate, and silicate salts. The alkali metal, e.g., sodium and potassium, carbonates, bicarbonates, and silicates are particularly useful herein.

Water-soluble, organic builders are also useful herein. For example, the alkali metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylenediaminetetraacetic acid, nitrilotriacetic acid, oxydisuccinic acid, mellitic acid, benzene polycarboxylic (i.e., penta- and tetra-) acids, and citric acid.

Highly preferred non-phosphorus builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other highly preferred organic builders herein are the polycarboxylate builders set forth in U.S. Pat. 3,308,067, Diehl, incorporated herein by reference. Examples of such materials include the water-soluble salts of homo- and co-polymers of aliphatic carboxylic acids such as maleic acid, itanconic acid, mesaconic acid, fumaric acid, aconitic acid, citraconic acid and methylenemalonic acid.

Additional, preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phloroglucinol trisulfonate.

Sodium nitrilotriacetate is an especially preferred, water-soluble organic builder herein.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in the co-pending application of Benjamin, Ser. No. 248,546, filed Apr. 28, 1972, the disclosures of which are incorporated herein by reference.

More particularly, the seeded builders useful herein comprise a crystallization seed having a maximum particle dimension of less than 20 microns, preferably a particle diameter of from about 0.001 micron to about 5 microns, in combination with a material capable of forming a water-insoluble reaction product with free metal ions.

Many builder materials, e.g., the water-soluble carbonate salts, precipitate water hardness cations, thereby performing a builder function. Unfortunately, many of the precipitating builders used in detergent compositions do not reduce the free metal ion content of laundry baths quickly, and such builders only compete with the organic detergent and the soil for the free metal ions. The result is that while some of the free metal ions are removed from the solution, some ions do react with the organic detergent and the soil, thereby decreasing the detersive action. The use of the crystallization seed quickens the rate of precipitation of the metal hardness, thereby removing the hardness ions before they can adversely affect the detergency performance.

By using a material capable of forming a water-insoluble product with free metal ions in combination with a crystallization seed, the combined free metal ion concentration of an aqueous laundering liquor can be reduced to less than 0.5 grains of hardness within about 120 seconds. In fact, the preferred seeded builders can reduce the free metal hardness to less than 0.1 grains/-gallon within about 30 seconds.

Preferred seeded builders consist of: a water-soluble material capable of forming a reaction product having a solubility in water of less than about $1.4 \times 10^{-2}$ wt.% (at 25° C) with divalent and polyvalent metal ions such as calcium, magnesium and iron; and a crystallization seed (0.001–20 micron diameter) which comprises a material which will not completely dissolve in water within 120 seconds at 25° C.

Specific examples of materials capable of forming the water-insoluble reaction product include the water-soluble salts of carbonates, bicarbonates, sesquicarbonates, silicates, aluminates and oxalates. The alkali metal, especially sodium, salts of the foregoing materials are preferred for convenience and economy.

The crystallization seed employed in such seeded builders is preferably selected from the group consisting of calcium carbonate; calcium and magnesium oxalates; barium sulfate; calcium, magnesium and aluminum silicates; calcium and magnesium oxides; calcium and magnesium salts of fatty acids having 12 to 22 carbon atoms; calcium and magnesium hydroxides; calcium fluoride; and barium carbonate. Specific examples of such seeded builder mixtures comprise 3:1 wt. mixtures of sodium carbonate and calcium carbonate having a 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

A seeded builder comprising a mixture of sodium carbonate and calcium carbonate is especially preferred herein. A highly preferred seeded builder comprises a 30:1 to 5:1 (wt. $Na_2CO_3$:$CaCO_3$) mixture of sodium carbonate and calcium carbonate wherein the calcium carbonate has an average particle diameter from 0.01 micron to 5 microns.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, to R. A. Bauman, issued Jan. 28, 1969, incorporated herein by reference.

The complex aluminosilicates, i.e., zeolite-type materials, are another type of substantially water-insoluble builder useful in the present compositions, and these materials readily soften water, i.e., remove $Ca^{++}$ hardness. Both the naturally occurring and synthetic "zeolites," especially the zeolite A and hydrated zeolite A materials. are useful for this builder/softener purpose. A description of zeolite A materials and a method of preparation appears in U.S. Pat. No. 2,882,243, entitled MOLECULAR SIEVE ADSORBENTS, issued Apr. 14, 1959, incorporated herein by reference.

Optional Ingredients

The compositions herein can contain all manner of detergent adjunct materials and carriers commonly found in laundering and cleaning compositions. For example, various perfumes, optical bleaches, fillers, anti-caking agents, fabric softeners and the like can be present to provide the usual benefits occasioned by the use of such materials in detergent compositions.

Enzymes, especially the thermally stable proteolytic and lipolytic enzymes used in laundry detergents, can be dry-mixed in the compositions herein.

The peroxyacid bleach compounds of the instant invention can desirably be incorporated in an amount of up to about 50% (wt.) of the total composition. Normally, the peroxyacid plus di-ketone bleach and dye transfer inhibition composition is used in combination with the detergent component and/or optical ingredients or fillers in a weight ratio range of bleach composition; detergent or filler from 10:1 to about 1:3.

The solid peroxygen bleaching compositions herein are prepared by simply admixing the ingredients. When preparing mixed detergent/bleaches, the peroxyacid and activator can be mixed either directly with the detergent compound, builder, etc., or the peroxyacid and activator can be separately or collectively coated with a water-soluble coating material to prevent premature activation of the bleaching agent. The coating process is conducted according to known procedures in the art utilizing known coating materials. Suitable coating materials include compounds such as magnesium sulfate hydrate, polyvinylalcohol, or the like.

Dye Transfer Inhibition Test Procedure

Bleaching compositions were prepared and tested for their ability to inhibit in-wash dye transfer according to the following procedure. Test fabrics weighing 2 grams each were simultaneously and individually washed in aqueous solutions containing bleaching and/or detergent compositions simulating actual in-the-wash compositions and concentrations. The test fabrics consisted of dark red polyester fabrics, white tracer terrycloth swatches and texturized white tracer nylon swatches.

The dye transfer inhibition, bleaching compositions were added in varied amounts to 500 ml of a 0.10% solution of a commercial, granular, built, fluorescer-free detergent. The pH was adjusted to the desired level (6–10) by adding a sufficient amount of a buffering agent. The load was washed in a one liter Tergotometer for 10 minutes at 130° F. All fabrics were then rinsed and allowed to air dry. The whiteness of the fabrics was then ascertained utilizing a Gardener Color Difference Meter. Whiteness (W) was determined according to the following formula:

$$W = 100 - \sqrt{(100 - L)^2 + 2.3^2 (a^2 + b^2)}$$

wherein $L$, $a$, and $b$ are the Gardener Meter lightness and chromaticity coordinates. The meter readings were made using a single layer of fabric (thickness), which included standardized whiteness and backup plates.

The effectivenss of a particular dye transfer inhibition system was measured by computing Δ W as follows:

$$\Delta W_1 = W_{FF} - W_{Test}$$

wherein $W_{FF}$ is the Gardner Meter Whiteness of the tracer cloths washed by themselves (without dyed fabric) utilizing a fluorescer free detergent, and $W_{Test}$ is the Gardner Meter Whiteness of tracer clothes washed under identical conditions with the bleaching composition and with the dyed fabrics. Of course, $\Delta W$, can refer to $\Delta$ $W$ terry cotton or $\Delta$ $W$ nylon, according to the fabric graded. The amount of dye transferred to all the tracer swatches was computed as follows:

$$\Delta W_{Sum} = \Delta W_{Terrycotton} + \Delta W_{Nylon}$$

The less dye transferred to the tracer swatches the lower $\Delta W_{Sum}$ will be and, correspondingly, the greater the amount of dye transfer inhibition.

The dye transfer inhibition compositions of the present invention are further illustrated by the following examples which in no way should be construed as liminations of the invention.

EXAMPLE I

| Ingredient | Weight (grams) |
|---|---|
| Diperisophthalic acid* | 0.035 |
| 2,3-pentanedione | 0.005 |
| A commercial detergent comprising anionic surfactants, builders, fillers, etc., substantially as described hereinbefore | 0.500 |
| $Na_2HPO_4$ | 0.220 |
| $NaH_2PO_4 . H_2O$ | 0.135 |

*Diperisophthalic acid at this concentration is soluble in water and is additionally substantially converted in situ to its alkaline salt form.

The above composition was dissolved in 500 ml of water. The pH level was maintained in the 7.0 to 8.0 range by the phosphate buffering agents. Cotton and nylon fabrics were tested and analyzed for dye transfer inhibition utilizing the above-disclosed test method. A substantial decrease in dye transfer (lower $\Delta$ $W_{sum}$) resulted when the above composition was placed in the wash bath.

When p-nitroperoxybenzoic acid is substituted for diperisophthalic acid and 2,3-butanedione is substituted for 2,3-pentanedione, substantially the same results are obtained.

EXAMPLE II

A laundry composition which is suitable for cleaning, bleaching and inhibiting dye transfer in a wash bath is as follows.

| Ingredient | % (wt.) |
|---|---|
| Diperoxyisophthalic acid* | 3.8 |
| 2,3-pentanedione | 0.6 |
| A synthetic detergent comprising anionic surfactants, builders, fillers, etc., substantially as described hereinbefore | 55.9 |
| $Na_2HPO_4$ | 24.6 |
| $NaH_2PO_4 . H_2O$ | 15.1 |

*Diperoxyisophthalic acid is substantially water-soluble at this concentration.

The above described composition is used as follows. 122 Grams of the above composition are dissolved in 18 gallons of water at 120° F contained in a top loading automatic washer. The pH of the solution is maintained at 7.5 when the above concentration is used. Soiled clothes are introduced into the washer and washed for 10 minutes. Excellent bleaching results are secured; little or no undesirable transfer of dyes between fabrics is noted.

EXAMPLE III

A bleach activator dye transfer inhibition composition is prepared as follows.

| Ingredient | % (wt.) |
|---|---|
| Diperazelaic acid* | 3.8 |
| 2,3-butanedione | 0.6 |
| A synthetic detergent comprising builders, fillers, etc., substantially as described hereinbefore | 55.9 |
| $Na_2HPO_4$ | 24.6 |
| $NaH_2PO_4 . H_2O$ | 15.1 |

Soiled clothes are washed according to the procedure set forth in Example II with substantially the same results. Cotton and nylon fabrics are tested and analyzed for dye transfer inhibition according to the before-described test procedure. A decrease in dye transfer is noted when the above composition is utilized.

When m-chloroperoxybenzoic acid* is substituted for the diperazelaic acid above, substantiallly the same results are obtained.

*These acids are substantially water-soluble at use concentrations.

What is claimed is:

1. A bleaching and dye transfer inhibition composition, consisting essentially of:

a. from about 1% to 75% by weight of a water-soluble organic peroxyacid or salt thereof bleaching agent of the formula

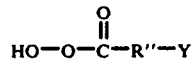

wherein R'' is an alkylene group containing from 1 to about 16 carbon atoms or an arylene group containing from 6 to about 8 carbon atoms and Y is hydrogen, halogen, alkyl, aryl,

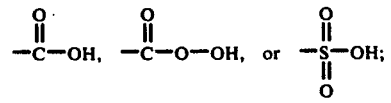

b. from about 0.1% to 50% by weight of a water-soluble di-ketone activator of the formula

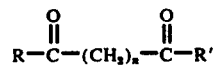

wherein $n$ is 0 or 1 and R and R' are alkyl and substituted alkyl moieties having from 1 to 20 carbon atoms; aryl and substituted aryl moieties; heterocyclic moieties; or moieties wherein R and R' are joined in a ring structure having 5 to 12 carbon atoms; and c. from about 1% to 85% by weight of a buffering agent to maintain the in-use pH of the composition within the range of from 6 to 10.

2. The composition of claim 1 wherein the organic peroxyacid is diperoxyazelaic acid, diperoxyadipic acid, m-chloroperoxybenzoic acid, p-nitroperoxybenzoic acid or diperoxyisophthalic acid.

3. The composition of claim 2 wherein the di-ketone activator is 2,3-pentanedione, 2,3-butanedione, di-2-pyridyl glyoxal, 1-phenylpropane-1,2-dione, 2,4-pentanedione, or 2,4-hexanedione.

4. The composition of claim 3 wherein the mole ratio of bleaching agent to di-ketone activator is in the range of from 10:1 to 1:3.

5. The composition of claim 4 wherein the buffering agent is an alkali metal phosphate, carbonate or bicarbonate.

6. An activated peroxygen bleaching and dye transfer inhibition process comprising contacting soiled fabrics with an effective amount of a bleach and dye transfer inhibiting composition, consisting essentially of:

a. from about 1% to 75% by weight of a watersoluble organic peroxyacid or salt thereof bleaching agent of the formula

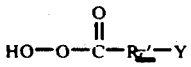

wherein R'' is an alkylene group containing from 1 to about 16 carbon atoms or an arylene group containing from 6 to about 8 carbon atoms and Y is hydrogen, halogen, alkyl, aryl,

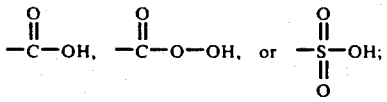

b. from about 0.1% to 50% by weight of a water-soluble di-ketone activator of the formula

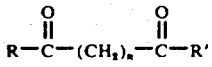

wherein n is 0 or 1 or R and R' each can be alike or different and are alkyl or substituted alkyl moieties having from 1 to 20 carbon atoms; aryl or substituted aryl moieties; heterocyclic moieties; or moieties wherein R and R' are joined in a ring structure having 5 to 12 carbon atoms; and c. from about 1% to 85% by weight of a buffering agent said buffering agent being a sodium carbonate, sodium bicarbonate, disodium hydrogen phosphate, sodium dihydrogen phosphate or mixtures thereof, to maintain the in-use pH of the composition within the range of from 6 to 10.

7. The process of claim 6 wherein the process is carried out in the presence of a detergent composition.

8. The process according to claim 6 wherein the water-soluble organic peroxyacid is diperoxyazelaic acid, diperoxyadipic acid, m-chloroperoxybenzoic acid, p-nitroperoxybenzoic acid or diperoxyisophthalic acid.

9. The process according to claim 8 wherein the water-soluble organic peroxyacid bleaching agent is in solution at a concentration from about 10 ppm to 20,000 ppm.

10. The process according to claim 9 wherein the di-ketone activator is 2,3-pentanedione, 2,3-butanedione, di-2-pyridyl glyoxal, 1-phenylpropane-1,2-dione, 2,4-pentanedione, or 2,4-hexanedione.

11. The process according to claim 10 wherein the di-ketone activator is in solution at a concentration from about 5 ppm to about 5,000 ppm.

12. A detergent composition consisting essentially of a. from about 1% to 50% by weight of the bleaching composition of claim 1;

b. from about 1% to 50% by weight of a detersive surfactant; and c. from about 1% to 60% by weight of a detergency builder.

13. The composition according to claim 12 wherein the detersive surfactant is an anionic surfactant.

14. The detergent composition of claim 12 wherein the organic peroxyacid is diperoxyazelaic acid, diperoxyadipic acid, m-chloroperoxybenzoic acid, p-nitroperoxybenzoic acid or diperoxyisophthalic acid, the diketone activator is 2,3-pentanedione, 2,3-butanedion, di-2-pyridyl glyoxal, 1-phenylpropane-1,2-dione, 2,4-pentanedione, or 2,4-hexanedione, and the buffering agent is an alkali metal phosphate, carbonate or bicarbonate.

* * * * *